United States Patent [19]

Boruta

[11] 4,456,216

[45] Jun. 26, 1984

[54] CARBURETOR FUEL BOWL VENT VALVE ASSEMBLY

[75] Inventor: Thaddeus Boruta, Livonia, Mich.

[73] Assignee: Ford Motor Company, Dearborn, Mich.

[21] Appl. No.: 385,154

[22] Filed: Jun. 4, 1982

[51] Int. Cl.[3] ..... F02M 5/08

[52] U.S. Cl. ..... 251/11; 251/DIG. 1; 123/516; 261/DIG. 67

[58] Field of Search ..... 123/516, 517, 518, 519, 123/520; 251/11, 360, DIG. 1; 261/DIG. 67, 72 R, DIG. 74, 41 D

[56] References Cited

U.S. PATENT DOCUMENTS

| | | | |
|---|---|---|---|
| Re. 30,552 | 3/1981 | Ludwig | 137/468 |
| 2,917,110 | 12/1959 | Brohz | 123/516 |
| 3,400,906 | 9/1968 | Stocklin | 251/11 |
| 3,847,178 | 12/1974 | Keppel | 251/DIG. 1 |
| 4,092,994 | 6/1978 | McGowan | 251/DIG. 1 |
| 4,283,356 | 8/1981 | Arai | 123/519 |
| 4,377,146 | 3/1983 | Oniki | 123/520 |

*Primary Examiner*—Charles J. Myhre
*Assistant Examiner*—Carl Stuart Miller
*Attorney, Agent, or Firm*—Robert E. McCollum; Clifford L. Sadler

[57] ABSTRACT

A carburetor fuel bowl vent valve assembly consists of a one-piece plastic housing having a central partition with a central well defining a zigzag shaped path for the flow of fuel vapors from the carburetor fuel bowl to a carbon canister. The well contains a vacuum operated vent valve that is spring opened during engine-off operation to allow the storage of fuel vapors under engine hot soak conditions, and is closed by engine manifold vacuum during engine running operation so that the fuel vapors will be rerouted into the engine. The vent valve further includes thermally responsive means to close the vent valve during low ambient temperature conditions. It also includes seal locating means that retain the seal in position without stretching or deforming it.

7 Claims, 4 Drawing Figures

CARBURETOR FUEL BOWL VENT VALVE ASSEMBLY

This invention relates in general to a vent valve for an automotive type carburetor fuel bowl. More particularly, it relates to a temperature sensitive one that is controlled by engine vacuum to prevent venting of vapors when the engine is running or the temperature is below a predetermined level.

Carburetor vacuum actuated fuel bowl vent valves are known. For example, U.S. Pat. No. 4,258,685, Arai et al, shows such a valve, as does U.S. Pat. No. 3,001,519, Dietrich et al, and U.S. Pat. No. 4,308,842, Watanabe et al. Each of these references shows a spring controlled vent valve controlled by engine vacuum to regulate the flow of fuel bowl vapors. In each case, however, no particular sealing structure is provided that positively prevents the flow of fuel vapors when the valve is closed. The references also do not show any thermally responsive means for controlling the vapors in response to ambient temperature changes.

U.S. Pat. No. 4,149,504, Walters, and U.S. Pat. 4,203,401, Kingsley et al, both show vacuum operated vent valves of the poppet or disc valve type that are spring loaded in one direction to control the flow of carburetor fuel bowl vapors in response to engine operation. The valves in this case seal against the end of the cage means forming part of the valve structure. No thermally responsive members are provided to control the flow in response to ambient temperature changes.

U.S. Pat. No. Re. 30,552, Ludwig, shows a thermally responsive carburetor fuel bowl vent valve that seats against an O-ring seal to prevent flow of vapors under certain temperature and engine vacuum conditions. In this case, however, the O-ring is located in place by an interference fit with the O-ring and an upstanding annular locater over which it is stretched. The O-ring is not operable in a free or unstressed state.

This invention relates to an essentially one-piece carburetor fuel bowl vent valve assembly that closes against a seal to positively prevent the flow of fuel vapors under predetermined conditions.

Another object of the invention is to provide a vent valve of the type described that is thermally responsive to close below certain temperature levels to direct the vapors into the engine prior to a cold engine start operation.

A still further object of the invention is to provide a carburetor fuel bowl vent valve with an O-ring sealing means that is assembled and located so that the O-ring is unstressed or in its free state, this being accomplished by providing an annular confining means of a diameter slightly larger than the outer diameter of the O-ring projecting from the vent valve assembly housing.

Other objects, features and advantages of the invention would become more apparent upon reference to the succeeding detailed description thereof, and to the drawings illustrating the preferred embodiments thereof; wherein, FIG. 1 is a cross-sectional view of a carburetor fuel bowl vent valve embodying the invention taken on a plane indicated by and viewed in the direction of the arrows I—I of FIG. 2;

Figure 1:
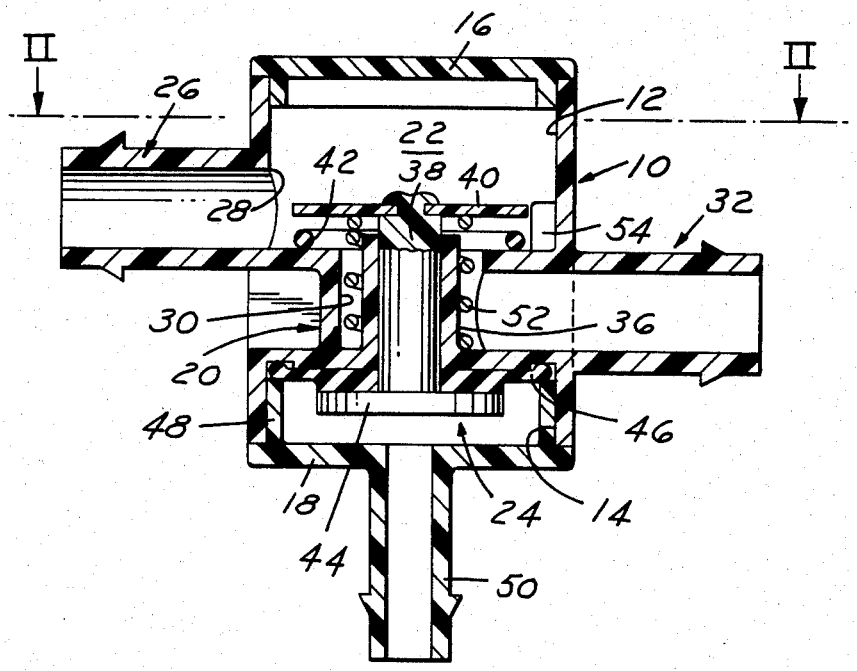
Figure 2:
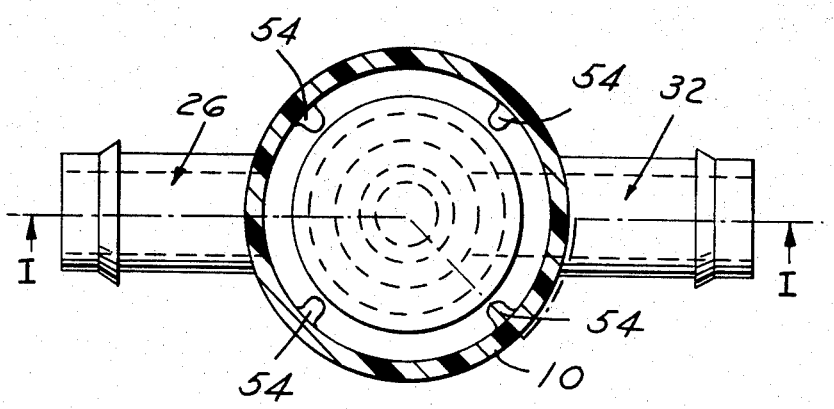
FIG. 2 is a top view of the vent valve assembly of FIG. 1 with the cover removed and taken on a plane indicated by and view in the direction of the arrows II—II of FIG. 1.

The vent valve of the invention as seen in FIG. 1 consists of a one-piece plastic cylindrical housing 10 open at its upper and lower ends 12 and 14. The upper end is closed by an annular channel shaped cover 16, the lower end being closed by the channel shaped shell 18 of a vacuum servo housing.

Housing 10 is formed with a central partition 20 that divides the casing into an upper fuel vapor chamber 22 and a lower vacuum chamber 24. Chamber 22 is adapted to be connected to the carburetor fuel bowl, not shown, by an outlet tube 26 communicating with chamber 22 through an opening 28 in the side wall of housing 10.

The partition 20 has a centrally located well 30 that is open at its upper end flush with chamber 22 and closed at its lower end by the lower wall of partition 20. The lower portion of well 30 communicates with an automotive type carbon canister through a passage or conduit 32 that projects through the side wall of housing 10 and into the fuel well 30, as shown. This construction provides a zigzag path for the flow of fuel vapors from the carburetor fuel bowl through the inlet tube 26 into chamber 22 and therefrom into the outlet line 32.

The normal objective in a vent valve of this type is to allow during engine hot soak conditions the flow of fuel vapors from the carburetor fuel bowl into the carbon canister to be adsorbed therein for storage during engine shutdown. During engine operation, this flow of vapors generally is cut off and the vapors generated vented internally of the carburetor to richen the air/fuel mixture charge. For this purpose, the vent valve construction described above includes a valve located in the well 30 interconnecting the inlet and outlet lines or tubes 26 and 32. More specifically, the well 30 is formed with a sleeve 36 that slidably receives a plunger 38. Secured to the upper end of plunger 38, as by peening as shown, is a disc valve 40 of a diameter sufficient to overlay the opening of well 30 to close the same at times. Located beneath disc valve 40 is an O-ring seal 42 that cooperates with the disc valve when plunger 38 is moved downwardly to positively seal the opening on well 30 to prevent vapor flow between tube 26 and 32.

The lower end of plunger 38 has secured to it an actuator disc 44 on the topside of which is located an annular flexible diaphragm 46. The latter is edge mounted as shown in the space between partition 20 and the inner projection of the annular flange 48 of the servo cover or housing 18. Diaphragm 46 is adapted to be subjected to changes in engine vacuum in chamber 24 through an adapter tube 50 connected to any suitable source of changing engine vacuum, such as intake manifold vacuum, for example. The disc valve 40 is biased in the opposite direction by a spring 52 seated between partition 20 and disc valve 40.

One of the features of the invention includes the manner in which O-ring seal 42 is located in place without initially stressing the O-ring. In the prior art devices, for example, such as is seen in U.S. Pat. No. Re. 30,552, it is common to provide an internal annular lip of a diameter slightly larger than the internal diameter of the O-ring seal with which it cooperates for stretching the O-ring seal over the lip and thereby locating it positively in place. This manner of retention, however, increases the mold cost and stretches the O-ring so that its durability is lowered.

The O-ring retention means of this invention is of a captive design that permits the installation of the O-ring in its free unstressed state and is more forgiving for out of tolerance parts. More specifically, housing 10 is formed in this case with four radially inwardly projecting barriers or keepers 54 equally circumferentially spaced around the housing 10. The barriers extend inwardly to a diameter slightly larger than the outer diameter of O-ring seal 42 and thereby permit the installation of the O-ring merely by dropping it in place without stressing, stretching or otherwise altering or deforming the O-ring. Obviously, a continuous annular member could be provided within the scope of the invention instead of only the four keepers or barriers 54, although it would not be preferred as it could reduce the flow. The barriers locate the O-ring radially while disc valve 40 prevents the O-ring from moving axially out of position.

Figure 3:
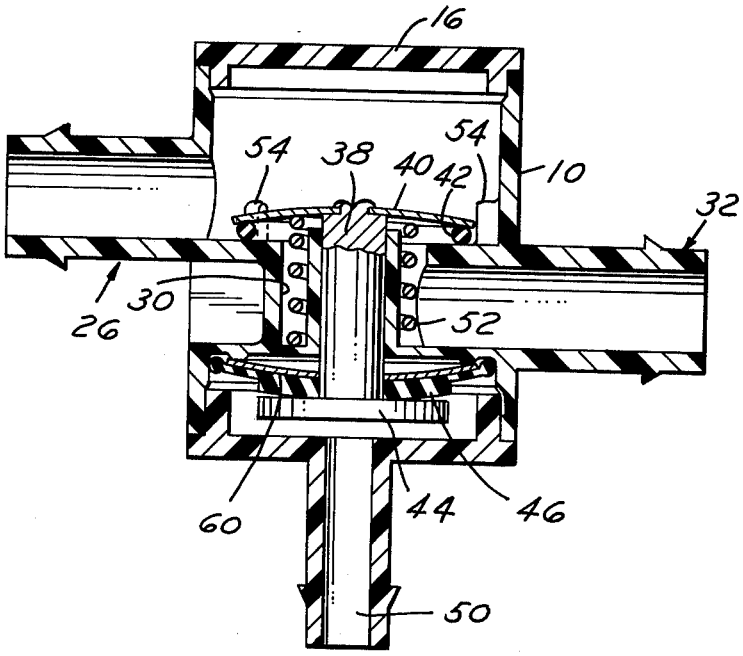
FIG. 3 is a view similar to FIG. 1 illustrating a further embodiment of the invention; and, FIG. 4 is a cross-sectional view of the housing of the embodiments shown in FIGS. 1 and 3.
Figure 4:
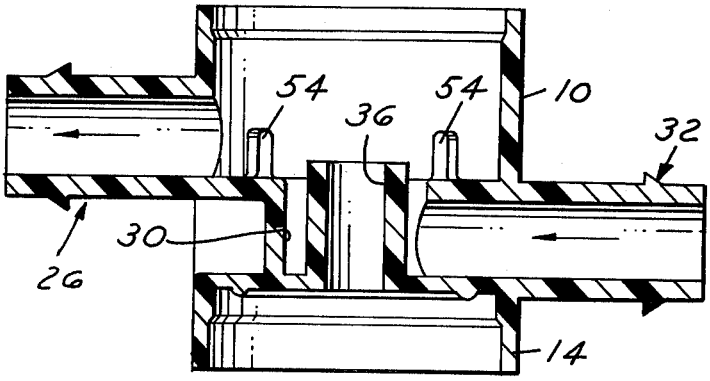

FIG. 3 shows an alternative construction that includes a pair of thermally responsive discs to control the flow of fuel vapors in response to changing ambient temperature conditions. More specifically, the construction of the housing 10 and central partition 20 and well parts remain the same as shown in FIG. 1. In the FIG. 3 modification, the disc valve 40 of FIG. 1 is replaced by a bimetallic thermally responsive disc valve 40', and a bimetallic thermally responsive disc 60 is located on the topside of annular flexible diaphragm 46, as indicated.

The overall operation of the device of FIG. 3 remains essentially the same as described in connection with FIG. 1 for normal engine on and off operations. However, when the temperature level drops or decreases below a scheduled point, the bimetallic discs 40' and 60 will snap overcenter to the concave positions shown in FIG. 3. This has the effect of moving plunger 38 downwardly and the disc valve 40' positively against O-ring seal 42 to block communication between passages 32 and 26, thereby preventing the flow of fuel vapors from the carburetor to the carbon canister. This is desirable for a cold engine start operation. It results in a richer air/fuel mixture charge being delivered to the engine intake manifold, which will help to overcome the internal resistance and friction of the engine when it is restarted.

In all other respects, above the scheduled or predetermined temperature level, the valve of FIG. 3 will operate in the same manner as that shown in FIG. 1. That is, when the scheduled temperature level is reached, the disc valve 40' and disc 60 will flatten out, thereby relieving the pressure against O-ring seal 42 and permitting spring 52 to move disc valve 40' upwardly. This will permit communication of fuel vapors between the tubes 32 and 26 when the engine is in an off condition and no vacuum exists in the line 50. When the engine is running, engine manifold vacuum in line 50 will draw the diaphragm 46 downwardly so that the disc 40', now flat, will move against the O-ring seal 42 and block the opening of well 30 to prevent communication between lines 26 and 32.

From the foregoing, it will be seen that the invention provides a simple, economically manufactured carburetor vent valve construction that is operable by engine manifold vacuum to positively seal the flow of fuel vapors from the carburetor to the carbon canister. It also will be seen that the seal is retained in place by means that are effective to locate the seal without stressing the same or stretching it, as is the common practice, which causes wear and reduces the life of the O-ring.

While the invention has been shown and described in its preferred embodiments, it will be clear to those skilled in the arts to which it pertains that many changes and modifications may be made thereto without departing from the scope of the invention.

I claim:

1. A carburetor fuel bowl vent valve assembly comprising a cylindrical housing having a hollow interior defining a fuel vapor chamber, a fuel vapor outlet connected to the chamber through a side wall portion of the housing, a centrally located well open at its upper end to the chamber and extending axially downwardly from the chamber to a closed lower end, a fuel vapor inlet connected to the well through another side wall portion of the housing for the flow of fuel vapors between the inlet and outlet through the well in a zigzag shaped path, and a valve assembly controlling the flow consisting of a disc-type valve overlying the well upper end and movably secured to a plunger projecting through the well, O-ring seal retaining means projecting radially inwardly into the chamber from the housing side wall to define an annular seal retaining enclosure, and an O-ring seal of an outer diameter slightly smaller than that of the enclosure adapted during assembly to be deposited within the enclosure over the plunger in a floating manner in a radial direction whereby the enclosure provides the sole means for lateral confinement of the O-ring seal while providing radial clearance between the O-ring and plunger, assembly of the valve disc to the plunger axially confining the O-ring between the disc and the housing, the valve assembly also including spring means normally biasing the disc valve to an open position, and vacuum operated servo means operable on the opposite end of the plunger to close the valve against the seal preventing communication of vapor between the inlet and outlet.

2. An assembly as in claim 1, including a flexible diaphragm secured in position against the lower end of the plunger, a secondary housing enclosing the diaphragm and forming a vacuum chamber therebetween, and a connection from the vacuum chamber to a source of engine vacuum for actuating the disc valve.

3. An assembly as in claim 2, including a thermally sensitive disc contiguous to the diaphragm and plunger biasing the diaphragm and plunger to a position closing the disc valve in response to predetermined ambient temperature conditions.

4. An assembly as in claims 1 or 3, the disc valve comprising a bimetallic plate operable to move at times from a flat position to a concave condition against the seal to close the well inlet in response to predetermined ambient temperature conditions.

5. A carburetor fuel bowl vent valve assembly comprising a hollow cylindrical housing open at its upper and lower ends, a cover closing the upper end, a central partition dividing the housing into upper and lower chambers, the partition having a well centrally located therein and open at one end to the upper chamber, the upper chamber having a fuel vapor outlet therefrom through the side wall of the housing, a fuel vapor inlet extending through another portion of the side wall into the well, and a valve unit for opening and closing the well to control the flow of vapors between the inlet and outlet, the unit including a plunger slidably mounted for axial movement through the well and projecting through both ends of the well, a disc valve secured to the upper chamber end of the plunger, an O-ring seal floatingly located over the plunger between the disc valve and central partition surrounding the well opening for sealing the opening upon movement of the disc valve against the O-ring seal, the housing having a plurality of finger-like, circumferentially spaced seal locating means projecting radially inwardly from the side wall to an internal diameter slightly larger than the outer diameter of the O-ring seal to radially confine the O-ring seal without interference of the seal with the plunger, the plunger having an actuator at its lower chamber end, a servo shell closing the lower end of the housing defining a vacuum chamber between the central partition and shell, a servo diaphragm secured to the actuator, and means connecting the lower chamber to a source of vacuum for moving the actuator and plunger and disc valve to a closed position, and spring means biasing the disc valve to an open position.

6. An assembly as in claim 5, the disc valve comprising a temperature sensitive plate movable against the O-ring below predetermined temperature conditions to close the well regardless of vacuum conditions.

7. An assembly as in claim 5 or 6, including a bimetallic temperature responsive spring member contiguous to the servo diaphragm urging the actuator and disc valve to close the well below predetermined temperature levels.

* * * * *